US005603653A

United States Patent [19]

Hartman

[11] Patent Number: 5,603,653

[45] Date of Patent: Feb. 18, 1997

[54] PERSPIRATION ABSORBENT PADS FOR FEMALE BREASTS

[76] Inventor: Kathie F. Hartman, 4640 DeLeon St., Apt. #144, Ft. Myers, Fla. 33907

[21] Appl. No.: 474,319

[22] Filed: Jun. 7, 1995

[51] Int. Cl.[6] ..... A41C 3/12; A41C 3/14; A41D 27/26

[52] U.S. Cl. ..... 450/56; 450/57; 2/267

[58] Field of Search ..... 2/53, 54, 55, 56, 2/57, 46, 73, 267; 450/53, 54, 55, 56, 57, 61, 62; 602/43, 58; 604/DIG. 904

[56] References Cited

U.S. PATENT DOCUMENTS

| | | | |
|---|---|---|---|
| 1,026,326 | 5/1912 | Leporin | 450/56 |
| 1,701,207 | 2/1929 | Johnson | 602/43 X |
| 1,750,084 | 3/1930 | Abrahamson | 2/113 |
| 2,104,725 | 1/1938 | Boris | 450/53 |
| 2,344,781 | 3/1944 | Mullen | 2/53 |
| 2,621,328 | 12/1952 | Duchnofskey | 450/53 |
| 3,588,916 | 6/1971 | Glatt | 2/53 |
| 3,620,222 | 11/1971 | Block . | |
| 4,047,534 | 9/1977 | Thomaschefsky et al. . | |
| 4,074,721 | 2/1978 | Smits et al. . | |
| 4,164,228 | 8/1979 | Weber-Unger . | |
| 4,545,080 | 10/1985 | Gorham . | |
| 4,816,004 | 3/1989 | Emanuel . | |
| 4,856,111 | 8/1989 | Sholes . | |
| 4,875,492 | 10/1989 | Mitchell et al. . | |
| 5,017,174 | 5/1991 | Gowryow . | |
| 5,032,103 | 7/1991 | Larsson . | |
| 5,042,088 | 8/1991 | Sherrod et al. . | |
| 5,403,300 | 4/1995 | Howarth | 604/904 X |

FOREIGN PATENT DOCUMENTS

| | | | |
|---|---|---|---|
| 958747 | 3/1950 | France | 450/56 |

*Primary Examiner*—Jeanette E. Chapman

[57] ABSTRACT

Various embodiments of perspiration absorbent pads for female breasts are provided, which are particularly adapted for placement between the overlying breast and the adjacent surface of the chest to preclude skin-to-skin contact and to absorb perspiration in that area. The pads may comprise generally cylindrical absorbent devices, having either random fiber or other fill material therein or a rolled sheet of absorbent material. Such cylindrically shaped pads provide for moisture absorption and also provide some uplifting of the breast to produce the appearance of a fuller bust line. Other embodiments comprise a relatively thin and flat pad, having a non-slip outer sheet of material, a moisture impervious layer, a thin moisture absorbent layer, and another layer to transfer moisture to the moisture absorbent layer. The relatively thin pads may also include a relatively thicker portion similar to the cylindrical pads, to provide greater absorption properties and uplift. Some of the pad embodiments are particularly adapted to be retained between the breast and adjacent chest, depending upon the fullness of the breast, and require no adhesives or other form of retention to remain in place. Others provide for attachment to the inner surface of the lower portion of a brassiere cup, to absorb perspiration emanating from the lower front portion of the breast. Any of the pad embodiments may be formed of reusable or economically disposable materials, as desired.

7 Claims, 4 Drawing Sheets

FIG. 1
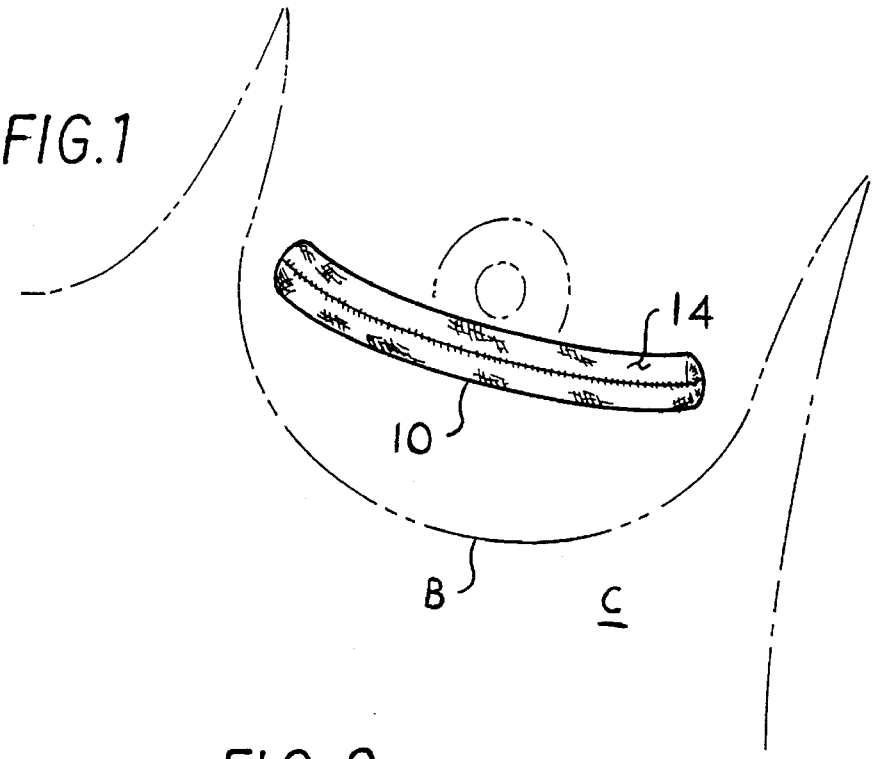
FIG. 2
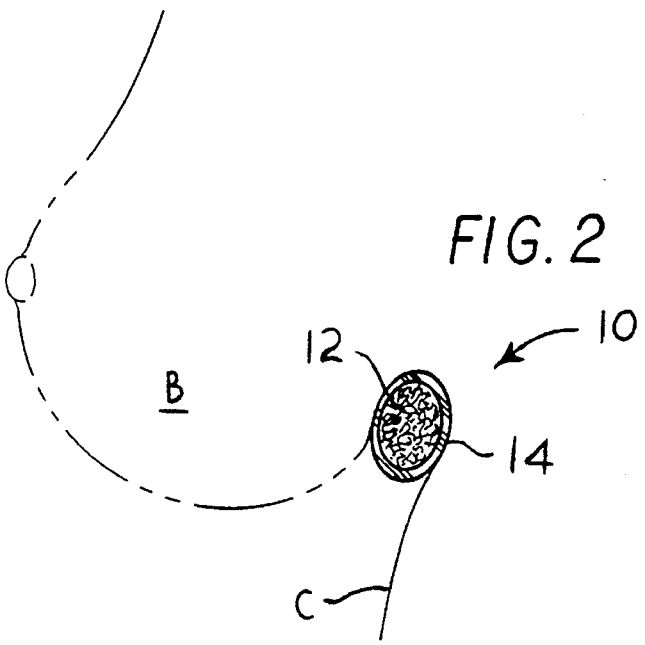
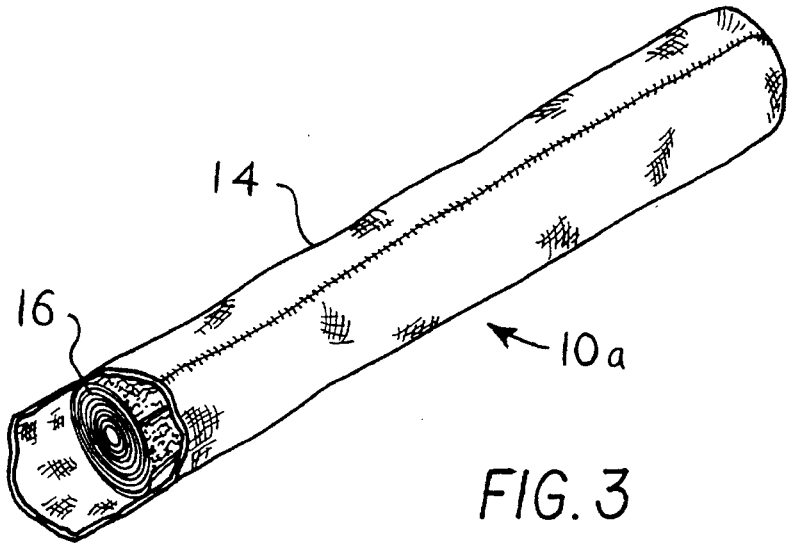
FIG. 3

FIG. 4
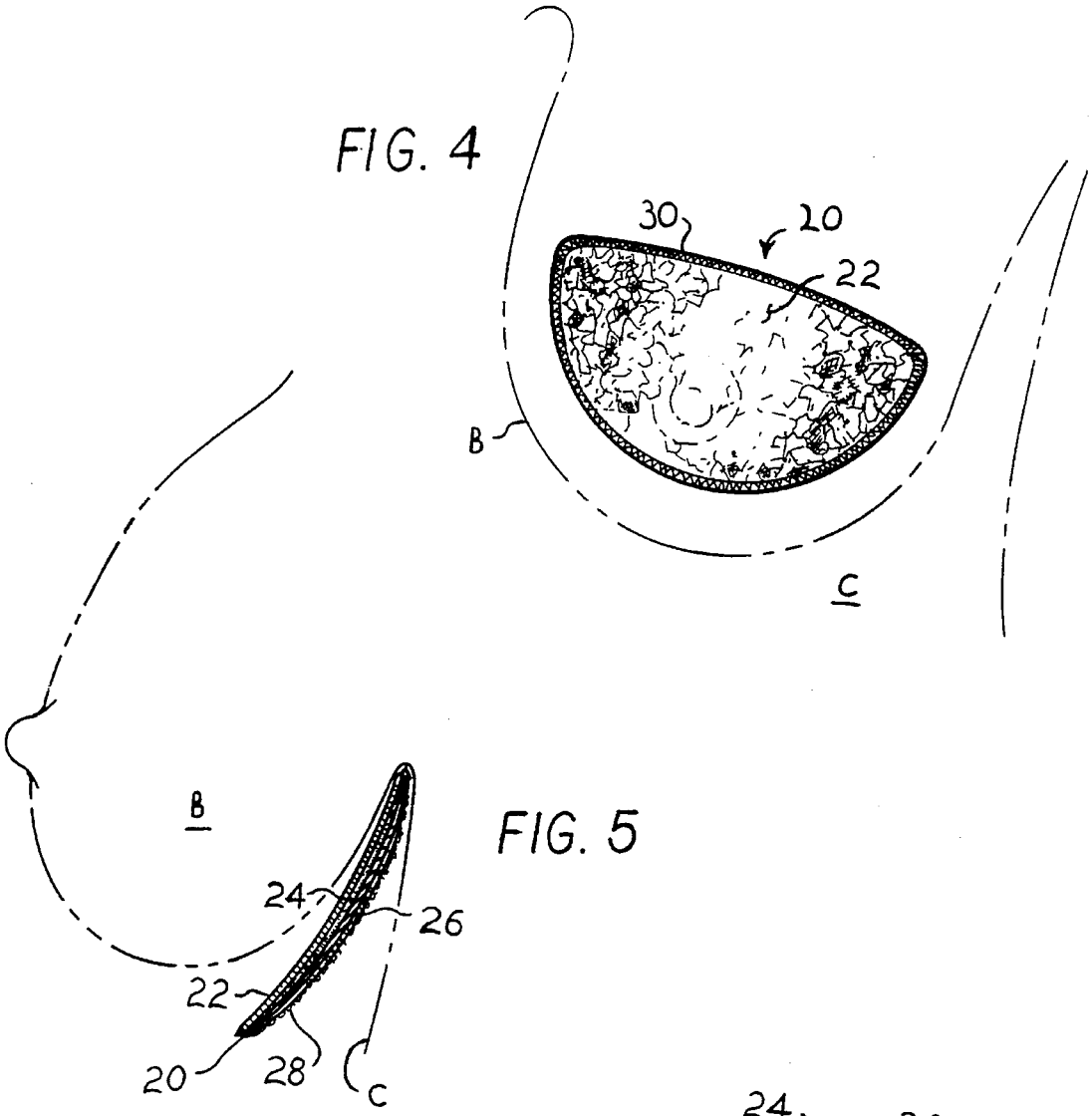
FIG. 5
FIG. 6
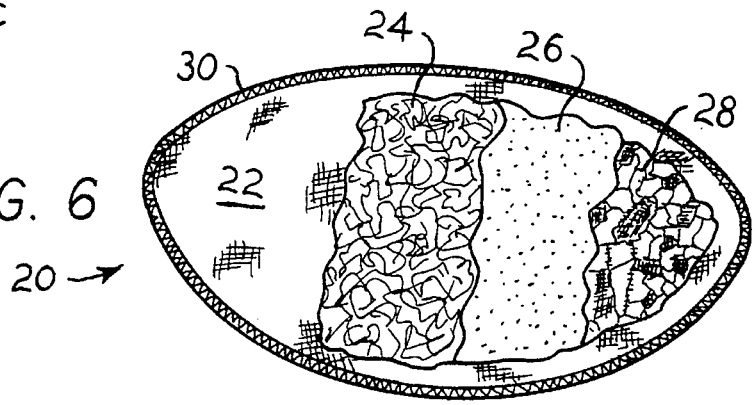
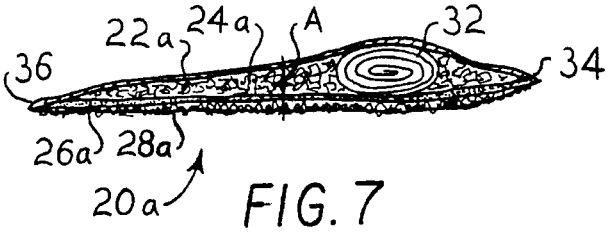
FIG. 7

PERSPIRATION ABSORBENT PADS FOR FEMALE BREASTS

FIELD OF THE INVENTION

The present invention relates generally to moisture absorbent articles worn immediately adjacent to the skin, and more specifically to various embodiments of pads or the like, which are adapted specifically for placement between the underside of the female breast and the adjacent chest or rib cage. The pads are adapted for capture between the overlying breast and the chest, where they may absorb any perspiration which may emanate from the wearer, thereby increasing the comfort of the wearer of the pads. In an alternative embodiment, the pads may be secured to the inside of the lower portion of a brassiere cup, where they are in contact with the lower portion of the breast.

BACKGROUND OF THE INVENTION

Contact between adjacent skin surfaces, in accompaniment with perspiration or other moisture, can create a very uncomfortable situation for a person so afflicted. Such contact may occur between the inner thighs and/or other areas of the body, but can be particularly irritating to the underside of womens' breasts. Such irritation is dependent upon the ambient temperature and humidity, the degree of contact under the breasts, and perhaps other factors, and thus may not be seen to be a problem by every women. However, the problem certainly exists, at least with many women, and can be particularly irksome and irritating at times. In some cases, the perspiration emanating surface may be contained within the cup of the brassiere, which material is not suitably absorbent and provides no relief of the problem.

While various pads and the like have been developed over the years to respond to various other perspiration or moisture problems (e.g., underarm shields, sanitary napkins, etc.), none have been developed for this critical problem of perspiration underlying the female breast. It is readily acknowleged that other devices have been developed for wear under the breast, but they are purposely relatively thick and bulky and intended for cosmetic uplift purposes, rather than to respond to the problem of under breast perspiration addressed by the present invention.

Accordingly, a need will be seen for a perspiration absorbent pad particularly adapted for use by women in absorbing under breast perspiration. The pad is placed between the overlying breast and the adjacent chest area, and serves to separate these portions of the anatomy to preclude chafing and other irritation, and also serves to absorb perspiration in the immediate area, thereby providing greater comfort to women using the device. The pads may be provided in various embodiments, from relatively thin and flat layered devices to articles having a generally cylindrical configuration, which different embodiments may be used by women as desired to respond to the above noted perspiration problem. A further embodiment is required for placement within the brassiere, to absorb perspiration from the breast surface which is captured within the brassiere.

DESCRIPTION OF THE PRIOR ART

U.S. Pat. No. 3,620,222 issued to Lester W. Block on Nov. 16, 1971 ; describes a Shelfless Pushup Brassiere Pad adapted for insertion in the cups of the brassiere, and providing coverage of the lower front three quarters of the breast. The Block pad is relatively thick, in accordance with its intended cosmetic purpose, and no moisture absorbent capability is specifically disclosed by Block. The present articles are specifically adapted for the absorption of moisture, are relatively thin in order to avoid any unnecessary apparent enlargement of the breast, and in at least some embodiments are adapted for wear between the underside of the breast and the adjacent chest area.

U.S. Pat. No. 4,047,534 issued to Susan N. Thomaschefsky et al. on Sep. 13, 1977 describes a Nursing Pad generally comprising a round disk having three absorbent layers of material therein. The pad is adapted for the absorption of any unwanted flow of lacteal fluid between nursings, and as such is adapted for wear over the front of the breast and generally centered over the nipple, rather than being shaped for insertion beneath the overlying breast, between the breast and the chest, or to be worn below the nipple of the breast. The Thomaschefsky et al. pad is resistant to flow through, but does not include a moisture proof barrier, as provided in at least some embodiments of the present perspiration absorbent pads.

U.S. Pat. No. 4,074,721 issued to Donald M Smits et al. on Feb. 21, 1978 describes Breast Pads for absorbing lacteal fluid between nursings, having a fluid transmitting layer immediately adjacent the breast, an intermediate absorbent layer, and an outer moisture barrier layer. The Smits et al. pads generally round, and are adapted for wear adjacent the front surface of the breast and centered on the nipple area, as in the Thomaschefsky et al. pad discussed above. Moreover, in at least one embodiment, the Smits et al. pad is relatively thick, having sufficient thickness for a central depression and radial channels to be formed therein. The result is much more closely related to the Thomaschefsky et al. nursing pad discussed above, than to the present invention.

U.S. Pat. No. 4,164,228 issued to Georg Weber-Unger on Aug. 14, 1979 describes a Pad For Nursing Brassieres generally comprising a cup shaped absorbent pad which overlies substantially all of the front of the breast. While in one embodiment an absorbent "apron" extending from the lower portion of the cup shaped main body is shown, the general thickness and stiffness of the attached cup shaped portion precludes insertion of the relatively thicker apron portion between the overlying breast and adjacent chest area of the wearer. Moreover, no moisture impermeable barrier is disclosed by Weber-Unger.

U.S. Pat. No. 4,545,080 issued to Mary Gorham on Oct. 8, 1985 describes a Disposable Underarm Perspiration Pad comprising an absorbent layer affixed to a moisture impervious layer. The pad is folded over the underarm area of a garment, with the moisture impervious layer in direct contact therewith, whereupon the moisture absorbent layer is placed against the underarm of the wearer when the garment is donned. The device is adapted for folding, as indicated above, and as such is not adaptable for use underlying an overlying fold of the breast or entirely within a brassiere. While the present invention uses a light tack adhesive to secure a disposable pad embodiment within a brassiere, other means are also disclosed and in any case the pads themselves are of a different configuration than those of Gorham.

U.S. Pat. No. 4,816,004 issued to Elizabeth Emanuel on Mar. 28, 1989 describes Means For Providing Uplift To The Female Bust, comprising a quarter spherical foam pad with a fabric covering thereover. The type of foam (open or closed cell) is not disclosed, but a closed cell foam would resist compression to a greater degree than an open cell foam, wherein the interconnected air cells and passages would allow air within the foam to be forced out, rather than being captured within the closed cells. However, such foam is not absorbent, since the closed cells cannot take in moisture or other material. Moreover, the very thick nature of the Emanuel pad is not suitable to may women, who may not wish to have additional cosmetic enhancement of their breasts.

U.S. Pat. No. 4,856,111 issued to Bessie M. Sholes on Aug. 15, 1989 describes a Perspiration Shield having numerous layers of absorbent materials, and including a moisture impervious layer and a sound absorbent layer, to preclude rustling or other noises from the moisture impervious or other layer(s). The Sholes shield includes activated charcoal for odor absorption, which is beyond the scope of the present pads, and the moisture impervious layer is disposed to the surface of the pad opposite the underarm skin. This layer also has adhesive means thereon, providing for securing the shield to the inner surface of the torso and arm juncture of the garment. The Sholes shield is also folded with a generally central saddle-shaped crease thereacross to conform to the shape of the garment, unlike the present pads.

U.S. Pat. No. 4,875,492 issued to Debra J. Mitchell et al. on Oct. 24, 1989 describes Washable and Contoured Nursing Pads having a convex, generally hemispherical section and fitting over the front of the breast and generally centered over the nipple. The Mitchell et al. pads are more closely related to the Weber-Unger pad than to the perspiration absorbent pads of the present invention.

U.S. Pat. No. 5,017,174 issued to Felicia B. Gowrylow on May 21, 1991 describes a Nursing Pad having a circular and low, flat conical configuration. Again, the pad is adapted for placement on the front of the breast and generally centered over nipple, and is more closely related to the pads of Weber-Unger and Mitchell et al. discussed above than to the present perspiration absorbent pads.

U.S. Pat. No. 5,032,103 issued to Karl O. A. H. Larsson on Jul. 16, 1991 describes a Breast Shield comprising a generally hemispherical rigid shell having an elastic member extending thereacross. The elastic member includes a center opening providing clearance for the breast nipple. The device is placed over the front of the breast to preclude chafing and further irritation thereof between nursings. Accordingly, the structure and function are unrelated to the present pads.

Finally, U.S. Pat. No. 5,042,088 issued to Earle H. Sherrod et al. on Aug. 27, 1991 discloses a Disposable Clothing Shield And Method Of Manufacture, comprising a generally elliptically shaped pad having an adhesive layer on one side thereof and a fold line dividing the pad at about two thirds its height. The adhesive coated side is secured to the inner surface of the underarm area of the garment, and the fold line folded thereover. The result is a pad more closely resembling the Gorham, Emanuel, and Sholes devices described above.

None of the above noted patents, taken either singly or in combination, are seen to disclose the specific arrangement of concepts disclosed by the present invention.

SUMMARY OF THE INVENTION

By the present invention, improved perspiration absorbent pads for female breasts are disclosed.

Accordingly, one of the objects of the present invention is to provide improved perspiration absorbent pads which in at least some embodiments are adapted for placement between the chest and the overlying underside of the breast of a woman, and for the absorption of perspiration occurring therebetween.

Another of the objects of the present invention is to provide improved perspiration absorbent pads which, in at least one embodiment, comprise a generally cylindrical configuration having either randomly disposed fiber fill or rolled sheet material fill therein, which configuration is adapted to lift the overlying breast to provide a fuller appearance while also absorbing perspiration between the breast and underlying chest.

Yet another of the objects of the present invention is to provide improved perspiration absorbent pads which, in at least some other embodiments, comprise generally flat and thin pads having a thin moisture absorbent layer of material therein and another moisture impervious sheet, contained in first and second outer sheets adapted to pass moisture therethrough.

Still another of the objects of the present invention is to provide improved perspiration absorbent pads which, in at least one other embodiment, comprise a relatively thin and flat pad including a relatively thicker rolled or otherwise formed absorbent element therein.

A further object of the present invention is to provide improved perspiration absorbent pads which, in at least one embodiment, include a layer of slip resistant material adapted to preclude slippage of the pads either between the overlying breast and the chest, or within a brassiere or other clothing.

An additional object of the present invention is to provide improved perspiration absorbent pads which may be formed of inexpensive and disposable materials providing for a single use, or alternatively may be formed of more durable materials providing for multiple wearings and launderings.

Another object of the present invention is to provide improved perspiration absorbent pads which may be secured to the inner surface of the lower portion of the cup of a brassiere, in order to absorb perspiration from the corresponding surface of the breast.

A final object of the present invention is to provide improved perspiration absorbent pads for female breasts for the purposes described, which are inexpensive, dependable and fully effective in accomplishing their intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 1 is a front perspective view of a first embodiment of the present perspiration absorbent pails, showing a cylindrical configuration adapted for placement beneath the overlying breast.

FIG. 2 is a side elevation view in section of the pad of FIG. 1, showing its internal structure.

FIG. 3 is a broken away perspective view of an alternative embodiment of the pad of FIGS. 1 and 2, having an absorbent interior of rolled sheet material.

FIG. 4 is a perspective view of an alternative pad, having a relatively thin and flat configuration.

FIG. 5 is a side elevation view in section of the pad of FIG. 4, showing its internal structure.

FIG. 6 is a broken away front elevation view of the pad of FIGS. 4 and 5, showing further details.

FIG. 7 is an alternative embodiment of the pad of FIGS. 4 through 6, including a generally cylindrical absorbent component.

Similar reference characters denote corresponding features consistently throughout the several figures of the attached drawings.

DETAILED DESCRIPTION OF THE PREFERRED EMBODIMENTS

Figure 8A:
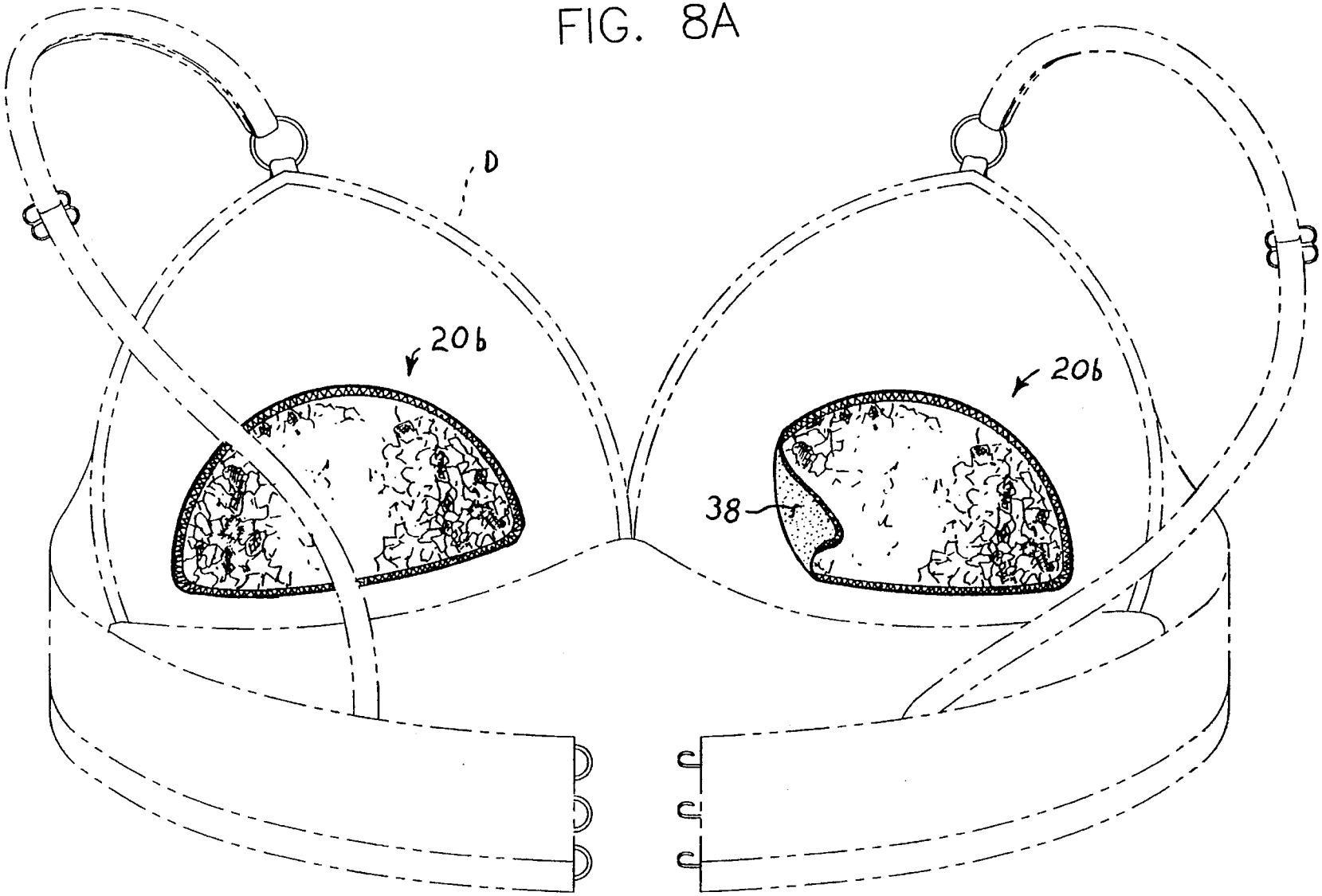
FIG. 8A is a perspective view of another embodiment, wherein a disposable pad is adhesively secured temporarily to the inner surface of the lower portion of a brassiere cup.

Referring now to the drawings, the present invention will be seen to relate to various embodiments of a perspiration absorbent pad for the female breast, providing for the comfort of the wearer thereof. FIG. 1 discloses a first embodiment perspiration pad 10, comprising a flexible, elongate, and generally cylindrical configuration and having a perspiration absorbent material 12 (FIG. 2) completely enclosed within a moisture permeable outer covering 14. The covering 14 may be a natural or synthetic woven or otherwise formed fabric material (e. g., cotton), which does not disintegrate when exposed to moisture, with the moisture absorbent fill 12 also being a natural or synthetic loose fiber material having suitable moisture absorbent properties. FIG. 3 discloses an alternative embodiment of the device of FIGS. 1 and 2, wherein a thin sheet of absorbent material 16 (e. g., cotton, although other materials may be used as desired) is rolled and used as the absorbent inner fill of the device, and enclosed within an outer covering 14, as in FIGS. 1 and 2.

The elongate and generally cylindrical shape of the pads 10 and 10*a* of FIGS. 1 through 3 are particularly adapted for capture between the overlying breast B and the underlying chest wall surface C, as shown in FIG. 2. Perspiration problems between adjacent areas of the skin (e. g., crotch, etc.) are well known, and perspiration in such areas can be particularly irritating. First, the adjacent and overlapping skin surfaces capture perspiration or other moisture therebetween, and preclude evaporation of the moisture. Second, the trapped moisture tends to soften the skin, making it more susceptible to irritation due to chafing and heat.

As noted above, the above described perspiration and irritation problem occurs particularly in areas of skin-to-skin contact in various areas of the body. Women with larger and/or overhanging breasts can be particularly susceptible to such irritation, and the present pads 10 and 10*a*, and others discussed further below, are of great assistance in overcoming the above perspiration problem. First, by providing a pad 10/10*a* which is particularly adapted for placement between the underside of the breast B and the adjacent chest surface C, the pad 10/10*a* provides separation between the two skin surfaces to preclude chafing therebetween. Second, by spacing apart the subject surfaces, more air is allowed to circulate between the surfaces, thereby assisting in the evaporation of moisture therefrom. (The porous nature of the materials used in the construction of the pads 10/10*a* are also of assistance in providing air circulation.)

In many cases, women may wish to provide some uplift for the breasts, and the pads 10/10*a* of the present invention also provide for such due to their diameters. The relatively thick, yet narrow, shape of the pads 10/10*a* provided by their generally cylindrical configuration (on the order of one half to three quarter inch in diameter, by three to six inches long; other dimensions may be used), enables such pads 10/10*a* to be placed completely under the overlying breast B, while still providing at least some uplift to the breast B, as shown in FIG. 2. The pads 10/10*a* tend to be captured between the breast B and the adjacent chest C, particularly when a brassiere or other support or other garment is worn. Thus, no adhesives or other securing means need be provided with the pads 10/10*a*, which securing means would detract from the permeability of the underlying cover 14 if placed thereon.

FIGS. 4 through 6 disclose another embodiment of the present perspiration absorbent pads. The pad 20 is a relatively thin, flat and generally elliptically shaped device, which is again particularly adapted for placement between the underside of breast B and the adjacent chest wall C, as indicated in FIG. 5. The relatively thin configuration of the pad 20 may be advantageous to those women who do not wish to add uplift to their breasts, with the relatively thin pad 20 being precluding the addition of any significant bulk or volume between the breast B and chest C, while still providing absorbent properties.

Pad 20 includes four separate and distinct layers or sheets of material. First, an outer layer 22 formed of a thin sheet of moisture permeable material (woven or otherwise formed natural or synthetic materials, cotton, etc. ) is provided, which is adapted for placement directly against the underside of the breast B. A second layer 24, adjacent to the first layer 22, provides the majority of absorptive capability, and is formed of a thin layer of fibrous or other moisture absorbent material (cotton batting, etc., as desired). In order to preclude the wicking of moisture through the pad 20 from one side to the other, a third moisture impermeable layer 26 (i. e., thin sheet of polyethylene plastic or other suitable material) is provided over the second layer 24, and opposite the first layer 22, to sandwich the second layer 24 between the outer cover sheet 22 and the moisture impervious sheet 26. Finally, another outer layer 28 of slip resistant material (i.e., an open lace or other patterned textile material, or other suitable material as desired) is provided, which outer layer 28 is particularly adapted for placement against the chest wall C and serves to preclude slippage of the pad 20 when in use.

The above layers 22 through 28 are secured together about their congruent peripheries by stitching 30, heat sealing, adhesive means, or other suitable means according to the materials used in the layers of material 22 through 28. FIG. 6 provides a clear view of the various layers 22 through 28 of the absorbent pad 20 and their relationship to one another.

In some circumstances, a woman may wish to have at least some uplift provided, in addition to having a moisture impervious barrier between the underside of the breast and the chest. The embodiment of FIG. 7 provides for such, wherein essentially one of the cylindrical pads 10/10*a* of FIGS. 1 through 3 is enclosed within a pad 20, as disclosed in FIGS. 4 through 6. The result is a pad 20*a*, as shown in FIG. 7. The first through fourth layers 22*a* through 28*a* of pad 20*a* are arranged in the same order as the layers 22 through 28 of the pad 20 discussed above, and comprise functionally equivalent materials. However, an additional cylindrically shaped moisture absorbent filler 32 is also placed within the pad 20*a*, between the first layer or outer cover 22*a* and the moisture impervious layer 26*e*. Preferably, this cylindrically configured filler 32 is formed of a rolled sheet of absorbent material, as in the case of the inner fill 16 of the pad 10*a* of FIG. 3, in order to retain its relatively thicker shape and to preclude inadvertent redistribution of the filler material throughout the pad 20*a* interior, as might occur if a loose fill material were to be used.

The cylindrical filler 32 of the pad 20*a* is placed in the pad 20*a* with its elongate axis parallel to the major axis A of the elliptically shaped pad 20*a*. (This major axis A is shown as a point in the cross sectional end view of FIG. 7. While the elliptical shape of the pad 20*a* is not shown specifically, it will be understood that it is substantially similar to the elliptical shape of the pad 20 shown in FIG. 6.) It will be further seen that the cylindrical filler is offset from the direct center of the pad 20*a*, and is located closer to the upper edge 34 (i. e., the edge placed directly into the fold of skin between the breast and the chest) than to the opposite lower edge 36. This positioning of the thicker portion of the pad 20*a*, due to the additional filler portion 32 therein, provides the same advantage as that of the cylindrical pads 10/10*a* of FIGS. 1 through 3, in that the relatively thicker portion of the pads tends to be captured between the overlying breast and the underlying chest wall, thus serving to secure the pad 20*a* in position without need for any adhesive or other securing means and the accompanying reduction in permeability of the outer cover layers or sheets 22*a* and 28*a*.

Figure 8B:
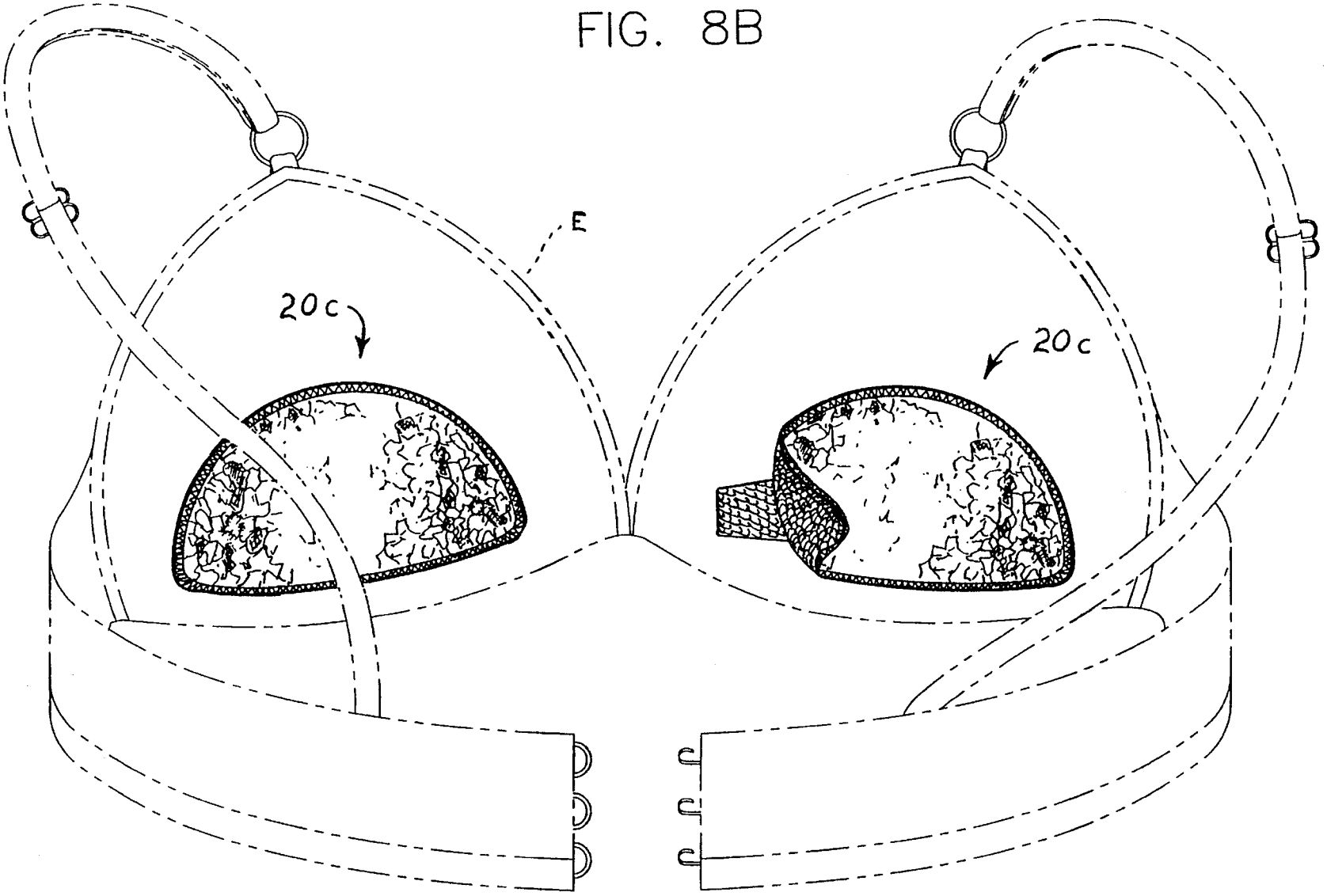
FIG. 8B is a perspective view of another embodiment, wherein a reusable pad is secured by means of hock and loop fabric material to the inner surface of the lower portion of a brassiere cup.

While the general structure and configuration of the various pad embodiments discussed above provide for the pads to be secured between the surface of the chest and the underside of the overlying breast solely by pressure between the skin surfaces serving to grip the pad therebetween, in some cases it may be found that additional security means may be desired for the pad(s). FIGS. 8A and 8B disclose such an arrangement, wherein pads 20*b* (FIG. 8A) and 20*c* (FIG. 8B) are respectively secured to the inner surface of the lower portion of a brassiere D (FIG. 8A) and E (FIG. 8B). Pads 20*b* and 20*c* are of like construction to pad 20 discussed above, with its first through fourth layers of material, with the exception of the securing means used to attach the pads either adhesively (for the disposable pad 20*b*) or reusably (for the reusable pad 20*c*).

FIG. 8A discloses an economically disposable, single use brassiere perspiration absorbent pad 20*b*. This pad 20*b* includes a light tack adhesive coating 38 on one surface of the pad 20*b*, which in turn is adhesively but removably secured to the inner surface of the cup of the bra D, as shown in the right hand side of the drawing figure. The pads 20*b* are adapted for placement so as to contact the lower portion of the breast below the nipple, which surface would normally rest against the inner surface of the cup of the bra D. Brassieres are not noted for perspiration absorbency, and in fact passage of perspiration moisture therethrough is not desirable due to the potential dampening and/or stains which may be transferred to the outer garments. The present pad 20*b* responds to this problem, by absorbing perspiration moisture from the lower front portion of the breast before it can reach the brassiere fabric material.

FIG. 8B discloses a means for securing a reusable pad 20*c* within a brassiere E. In order to provide for washing of the pad (and the bra E to which the pad 20*c* attaches), some other attachment means than adhesive is desirable. It has been found that mating hook and loop fastening material (e. g., Velcro,™) is suitable for such attachment. In the example of FIG. 8B, the loop portion 40*a* of the fastening material is permanently secured (stitched, etc.) to the inner surface of the lower portion of the bra cup, and the mating hook portion 40*b* of the material is in turn permanently secured to the mating surface of the reusable perspiration absorbent pad 20*c*. Thus, the pad 20*c* may be removed from the bra E by separating the two removably attached portions of mating material 40*a*/40*b*, for laundering of both the bra E and pad 20*c*. The mating hook and loop material 40*a*/40*b* used to secure the pad 20*c* to the bra E is exemplary, and other means for securing the pad 20*c* to the bra E may be used, as desired.

In summary, it will be seen that the present perspiration absorbent pads 10, 10*a*, and 20 through 20*c* are adapted to provide significant comfort to women who may suffer from perspiration between the breasts and the underlying chest surface, or from the lower frontal portion of the breast. The present pads are adapted for placement in those areas, and in at least some embodiments require no additional securing means to retain their position, particularly when the wearer is also wearing some additional support or other garment. Pads 10/10*a* and 20*a* are further adapted, by means of the thickness provided by their cylindrical shapes, to provide additional uplift for the breasts of the wearer. Alternatively, the relatively thin pad 20 (or 20*b* or 20*c*) may be used by those women who do not desire such uplift.

While the various pads 10/10*a* and 20, 20*a* and 20*c* of the present invention are shown with soft, woven fabric covers or cover sheets which are stitched together at their edges or seams, thus providing durability for multiple uses and launderings, it will be seen that the materials used in the construction of the present pads may also be relatively inexpensive, thereby allowing for the economical disposal of such a pad after a single wearing or use thereof, as in the case of the adhesively attached disposable pad 20*b*. In either case, the present pads serve to provide a significant improvement in comfort and convenience for women who are in need of a pad providing for the absorption of perspiration between breast and chest, or between breast and bra. The various pads of the present invention may be formed to any suitable size, with larger sizes being adapted for wear by women having larger breasts.

It is to be understood that the present invention is not limited to the sole embodiments described above, but encompasses any and all embodiments within the scope of the following claims.

I claim:

1. A perspiration absorbent pad for the female breast, comprising:

a flexible, substantially flat pad having a first layer comprising a moisture permeable cover sheet, a second layer comprising a thin sheet of moisture absorbent material, a third layer of thin moisture impermeable material, and a fourth layer of slip resistant material;

said pad further having a generally elliptical planform with an upper edge, a lower edge, and a major axis, and containing a generally cylindrical component of moisture absorbent material therein disposed between said cover sheet first layer and said moisture impermeable third layer, with said cylindrical component further being disposed generally parallel to said major axis and being offset toward said upper edge within said pad;

said pad having a size and shape adapted for placement beneath the underside of the female breast with said first layer directly in contact therewith, and with said upper edge and said cylindrical component adapted for positioning between the breast and the underlying surface of the chest, and further adapted for capture and retention between the breast and the underlying chest and precluding substantial contact therebetween, whereby;

said upper edge of said pad and said cylindrical component are placed between the breast and the underlying surface of the chest of the wearer of said pad and are captured and retained therebetween, thereby providing for the absorption of perspiration emanating from the underside of the breast by means of said moisture absorbent material therein, and further providing uplift to the breast by means of said cylindrical component within said pad.

2. The perspiration absorbent pad of claim 1 wherein:

said second layer of moisture absorbent material comprises a fibrous natural material.

3. The perspiration absorbent pad of claim 2 wherein:

said fibrous natural material is cotton.

4. The perspiration absorbent pad of claim 1 wherein:

said first layer is a woven fabric.

5. The perspiration absorbent pad of claim 1 wherein:

said fourth layer is a patterned textile material.

6. The perspiration absorbent pad of claim 1 wherein:

said cylindrical component comprises a rolled fabric sheet.

7. The perspiration absorbent pad of claim 1 wherein:

said pad is formed of materials adapted to be economically disposable after a single use.

* * * * *